US009124028B2

(12) United States Patent
Nakashima et al.

(10) Patent No.: US 9,124,028 B2
(45) Date of Patent: Sep. 1, 2015

(54) CONNECTOR HAVING MALE AND FEMALE TERMINAL HOUSINGS

(71) Applicant: YAZAKI CORPORATION, Tokyo (JP)

(72) Inventors: Takahito Nakashima, Toyota (JP); Hiroshi Kobayashi, Toyota (JP); Masao Nagano, Toyota (JP); Takayoshi Hirakawa, Makinohara (JP); Masayuki Saitoh, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 38 days.

(21) Appl. No.: 13/904,170

(22) Filed: May 29, 2013

(65) Prior Publication Data

US 2013/0323958 A1 Dec. 5, 2013

(30) Foreign Application Priority Data

May 29, 2012 (JP) ..... 2012-121703

(51) Int. Cl.
*H01R 13/627* (2006.01)
*H01R 13/422* (2006.01)

(52) U.S. Cl.
CPC ..... *H01R 13/6272* (2013.01); *H01R 13/4223* (2013.01); *H01R 13/6271* (2013.01)

(58) Field of Classification Search
CPC .. H01R 9/03; H01R 13/4223; H01R 13/4362; H01R 13/6272; H01R 13/6275
USPC ..... 439/350–354, 358, 595, 752
See application file for complete search history.

(56) References Cited

U.S. PATENT DOCUMENTS

| | | | | |
|---|---|---|---|---|
| 4,946,404 | A | 8/1990 | Takenouchi et al. | |
| 5,664,966 | A * | 9/1997 | Maegawa et al. | 439/595 |
| 5,775,932 | A | 7/1998 | Saito et al. | |
| 5,830,002 | A * | 11/1998 | Ito et al. | 439/358 |
| 6,012,946 | A * | 1/2000 | Fukase | 439/489 |
| 6,171,130 | B1 * | 1/2001 | Yoshida et al. | 439/352 |
| 6,579,113 | B2 * | 6/2003 | Kodama | 439/358 |

(Continued)

FOREIGN PATENT DOCUMENTS

| | | | |
|---|---|---|---|
| CN | 1146081 | A | 3/1997 |
| CN | 1720645 | A | 1/2006 |

(Continued)

OTHER PUBLICATIONS

Office Action issued Feb. 2, 2015 in Chinese patent application No. 201310206784.9 with English translation.

*Primary Examiner* — Thanh Tam Le
(74) *Attorney, Agent, or Firm* — Sughrue Mion, PLLC

(57) ABSTRACT

A connector includes: a female terminal housing provided with a terminal receiving cavity receiving a female terminal; and a male terminal housing retaining a male terminal to be connected to the female terminal. The male and female terminal housings have first and second engagement portions. The male and female terminal housings are fitted in a first fitting position by the first engagement portion. The male and female terminal housings are fitted in a second fitting position by the second engagement portion. The first fitting position is a position in which the locking hole of the female terminal is engaged with the lance of the terminal receiving cavity, and in which the male terminal is not in sliding contact with the female terminal. The second fitting position is a position in which the male terminal is in sliding contact with the female terminal.

3 Claims, 6 Drawing Sheets

(56) References Cited

U.S. PATENT DOCUMENTS

| | | | | |
|---|---|---|---|---|
| 6,669,510 | B2 * | 12/2003 | Yamawaki et al. | 439/595 |
| 7,393,233 | B2 * | 7/2008 | Machida et al. | 439/353 |
| 7,614,904 | B2 * | 11/2009 | Hiramatsu | 439/489 |
| 7,753,613 | B2 * | 7/2010 | Tsuji | 403/326 |
| 8,678,865 | B2 * | 3/2014 | Hiraishi | 439/752 |
| 8,708,739 | B2 * | 4/2014 | Takeda et al. | 439/595 |
| 2006/0160433 | A1 | 7/2006 | Machida et al. | |

FOREIGN PATENT DOCUMENTS

| | | | |
|---|---|---|---|
| JP | 2002-334739 | A | 11/2002 |
| JP | 2007-026769 | A | 2/2007 |
| JP | 2010-040263 | A | 2/2010 |
| JP | 2012-059565 | A | 3/2012 |

* cited by examiner

CONNECTOR HAVING MALE AND FEMALE TERMINAL HOUSINGS

CROSS-REFERENCE TO RELATED APPLICATION(S)

This application is based upon and claims the benefit of priority from prior Japanese patent application No. 2012-121703, filed on May 29, 2012, the entire contents of which are incorporated herein by reference.

BACKGROUND

The present invention relates to a fitting structure for a connector capable of connecting a plurality of female terminals with a plurality of male terminals.

There is a connector provided integrally with a female terminal housing having a plurality of terminal receiving cavities each of which receives a respective one of a plurality of female terminals therein, and a male terminal housing retaining a plurality of male terminals to be connected to the plurality of corresponding female terminals (e.g., see JP-A-2010-40263). According to the connector, the plurality of male terminals are press-fitted into the housing to protrude in the terminal receiving cavities of the plurality of female terminals, and each of the plurality of female terminals is inserted into a respective one of the plurality of terminal receiving cavities, thereby connecting the female terminals with the corresponding male terminals. In particular, according to a connector disclosed in JP-A-2010-40263, each of a plurality of female terminals is formed in a tubular shape including a resiliently deformable contact member therein. A locking hole formed in one side of the tube is engaged with a lance which is formed on an inner wall of a terminal receiving cavity and which is made of a resilient member, thereby preventing the female terminal from being released. At the fitting position, a male terminal is electrically connected to the contact member of the corresponding female terminal through sliding contact.

Meanwhile, there is a connector provided separately with a female terminal housing having a plurality of terminal receiving cavities each of which receives a respective one of a plurality of female terminals therein, and a male terminal housing retaining a plurality of male terminals to be connected to the plurality of corresponding female terminals (e.g., see JP-A-2012-59565 and JP-A-2007-26769). According to the connector, the female terminal housing and the male terminal housing are fitted with each other, and the plurality of male terminals are connected to contact members of the plurality of corresponding female terminals through sliding contact.

In particular, in JP-A-2012-59565, in order to prevent the female terminal housing and the male terminal housing from chattering at the fitting, an inner peripheral surface of one of the housings is provided with ribs for preventing the chattering, which are extended in a insertion direction, at two positions, and an outer peripheral surface of the other of the housings is provided with grooves into which the ribs are inserted, at corresponding two positions.

In addition, JP-A-2007-26769 discloses a lock structure of capable of locking the female terminal housing and the male terminal housing in a fitted state. According to the structure, a male hood formed on a front end of the female terminal housing is provided on its outer surface with a locking hook, and an inner surface of a female hood to be capped with the male hood is provided with a locking concave portion to lock the locking hook. When the female terminal housing and the male terminal housing are fitted to each other, the locking hook of the male hood is engaged which and locked to the locking concave portion of the female hood.

However, the connector 1 disclosed in JP-A-2010-40263 lacks consideration for reduction in inserting force of the female terminals. That is, to insert the female terminal connected to a wiring up to a predetermined position in the terminal receiving cavity, the inserting force to slide and insert the male terminal to the predetermined position while bending the contact member of the female terminal is required, in addition to the resiliently deforming force to bend the lance. Since the inserting force is large, an operator carrying out the work of inserting the female terminal may finish the terminal inserting work, in spite of a half-insertion state, so that a defect occurs in the insertion of the female terminal.

Further, in the connector disclosed in JP-A-2010-40263, there is no problem in the case where the male and female housings are integrally formed. However, in the case where the female terminal housing and the male terminal housing are separately formed, it is necessary to prevent the chattering when the housings are fitted to each other, as disclosed in JP-A-2012-59565. That is, the chattering may happen in a fitting portion depending on a manufacturing tolerance between the male housing and the female housing. In this regard, as disclosed in JP-A-2012-59565, since an outer surface and an is inner surface of hoods to be fitted are provided with the ribs and the grooves, the chattering can be prevented in a direction perpendicular to a wall surface of the groove. JP-A-2012-59565 lacks consideration for prevention of the chattering in a direction parallel with the wall surface of the groove. Further, the rib has a shape to be easily deformed in the direction perpendicular to the wall surface of the groove of the groove.

In the case where the female terminal housing and the male terminal housing are separately formed, as disclosed in JP-A-2007-26769, the lock mechanism for locking the female terminal housing the male terminal housing in the state in which they are fitted is required. According to the lock mechanism disclosed in JP-A-2007-26769, the locking hook should be locked to or unlocked from the locking groove by pressing the female hood from the outer surface to bend the female hood. Therefore, since the whole female hood is necessarily deformed largely, there is a problem that the inserting force at the fitting and the releasing force at the releasing are large.

SUMMARY

The present invention may provide a connector to reduce the maximum inserting force when a female terminal is connected with a male terminal, while a female terminal housing and a male terminal housing are separately formed, to effectively reduce chattering in a state in which a female terminal housing and a male terminal housing are fitted to each other, and to reduce an inserting force when a female terminal housing and a male terminal housing are fitted to each other, and a releasing force when they are released.

The connector may comprise: a female terminal housing provided with a terminal receiving cavity configured to receive a female terminal; and a male terminal housing configured to retain a male terminal to be connected to the female terminal, wherein a lance made of a resilient member and formed on an inner wall of the terminal receiving cavity is engaged with a locking hole formed in a tubular portion having a resiliently deformable contact member therein of the female terminal, and the male terminal housing and the female terminal housing are fitted to each other to allow the male terminal to be in sliding contact with the contact member of the female terminal, the connector wherein: the male terminal is insert-molded to the male terminal housing; the male terminal housing and the female terminal housing have a first engagement portion and a second engagement portion; the male terminal housing and the female terminal housing are fitted to each other in a first fitting position by the first engagement portion; the male terminal housing and the female terminal housing are fitted to each other in a second fitting position by the second engagement portion; the first fitting position is a position in which the locking hole of the female terminal is engaged with the lance, and in which the male terminal is not in sliding contact with the contact member of the female terminal; and the second fitting position is a position in which the male terminal is in sliding contact with the contact member of the female terminal.

One of the male terminal housing and the female terminal housing may be provided with a hole which is elongated in a fitting direction and which has a cross section of an L-shape, and the other of the male terminal housing and the female terminal housing may be provided with a member which protrudes therefrom to fit into the hole and which has a cross section of an L-shape.

One of the male terminal housing and the female terminal housing may be provided on its leading end with at least two guide ribs which are extended toward the other of the male terminal housing and the female terminal housing, and the other of the male terminal housing and the female terminal housing may be provided with at least one of guide grooves and guide tubes to which the two guide ribs are fitted.

The first engagement portion may include: a first arm which is provided on a first surface of the male terminal housing and which is formed with a first groove; and a first protrusion which protrudes from a first surface of the female terminal housing and which corresponds to the first groove of the first arm, the second engagement portion may include: a second arm which is provided on a second surface of the male terminal housing and which is formed with a second groove; and a second protrusion which protrudes from a second surface of the female terminal housing and which corresponds to the second groove of the second arm. In the first fitting position, the first protrusion is engaged with the first groove of the first arm, and a leading end of the second arm abuts against the second protrusion. In the second fitting position, the second protrusion is engaged with the second groove of the second arm.

BRIEF DESCRIPTION OF THE DRAWINGS

FIG. 1A is an exploded view, FIG. 1F is a diagram of a first fitted state, and FIG. 1C is a diagram of a second fitted state.

FIG. 2A is a side view illustrating a state in which a female terminal is not inserted in the first fitted state.

FIG. 2B is a side view illustrating a state in which the female terminal is inserted in the first fitted state, and FIG. 2C is a side view illustrating a state in which the female terminal is inserted in the second fitted state.

FIG. 3A is a side view of the first fitted state, and FIG. 3B is a side view of the second fitted state.

FIG. 4A is an enlarged perspective view of the female terminal housing when seen from the male terminal housing, and FIG. 4B is a front view of the female terminal housing when seen from the male terminal housing.

DETAILED DESCRIPTION OF EXEMPLARY EMBODIMENTS

Figure 1A:
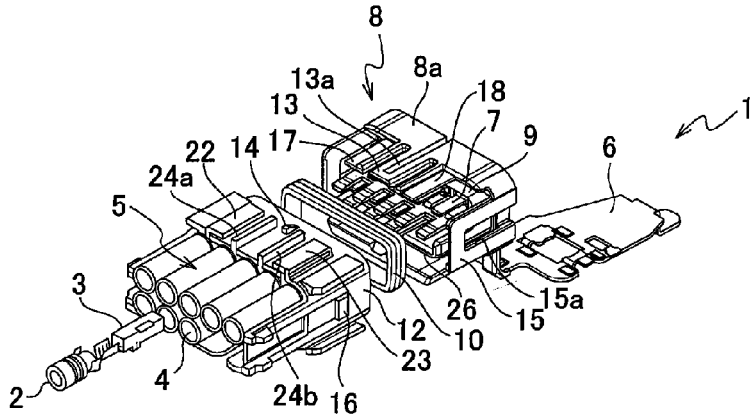
FIGS. 1A, 1B and 1C are perspective views illustrating the configuration of a joint connector according to an embodiment of a connector of the present invention.

One embodiment of the present invention in which a connector is applied to a waterproof ground joint connector will now be described with reference to FIGS. 1A to 6. As illustrated in the drawings, a waterproof ground joint connector 1 is a connector capable of connecting ends of a plurality of electric wires with a ground conductor in common. However, the connector of the present invention is not limited to the waterproof ground joint connector 1, but, of course, can be applied to a common connector capable of fitting a female terminal connector and a male terminal connector, or a simple joint connector.

Figure 2A:
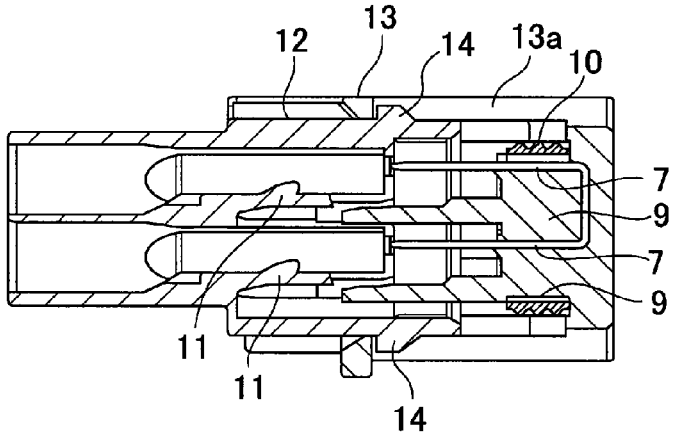
FIGS. 2A, 2B and 2C are cross-sectional views of the embodiment.
Figure 2B:
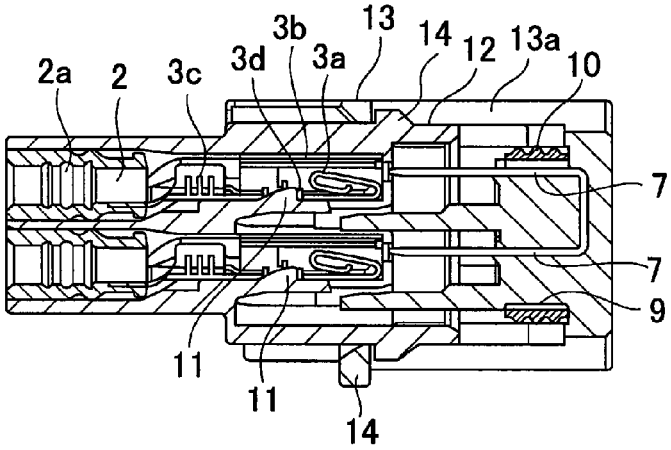
Figure 2C:
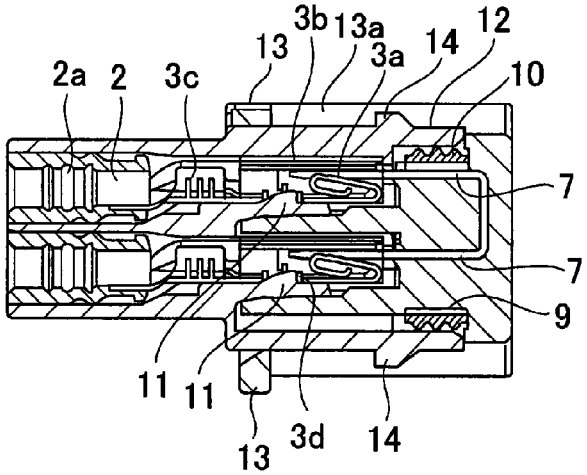
Figure 3A:
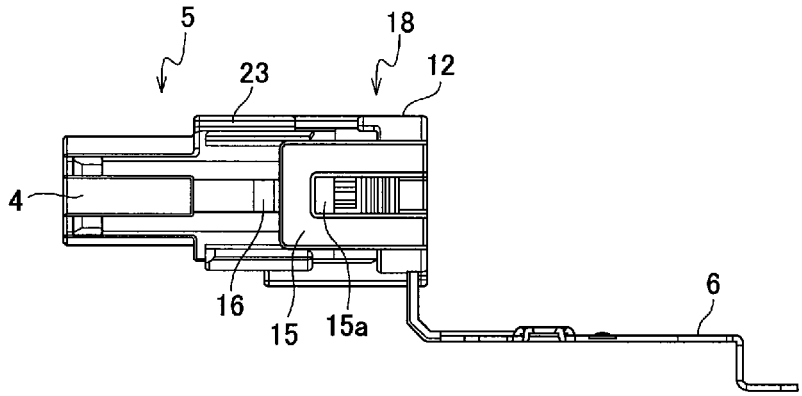
FIGS. 3A and 3B are side views of the embodiment.
Figure 3B:
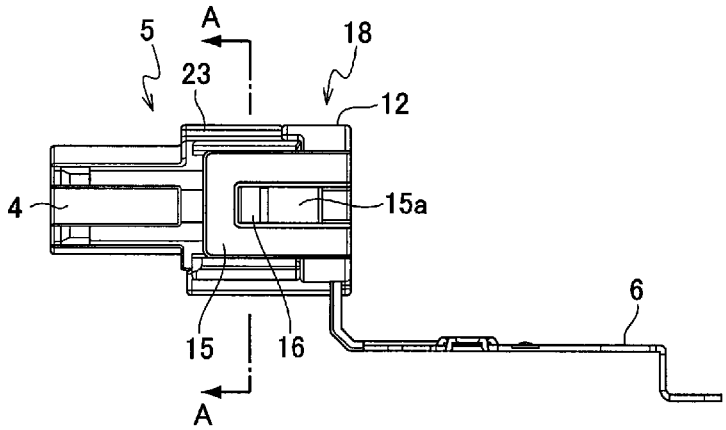
Figure 4A:
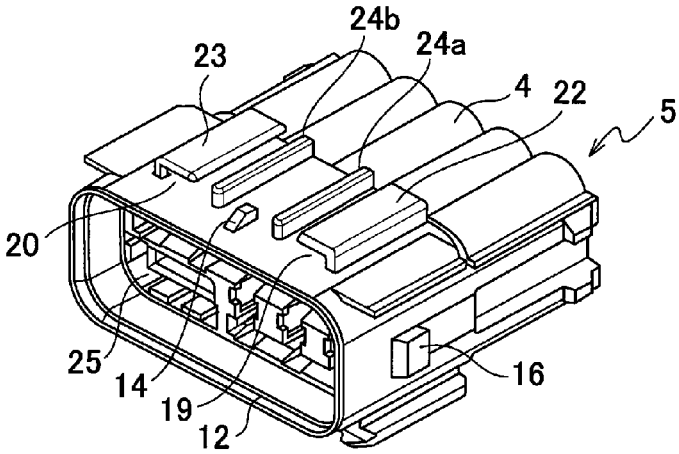
FIGS. 4A and 4B are diagrams illustrating the configuration of a female terminal housing and a male terminal housing.
Figure 4B:
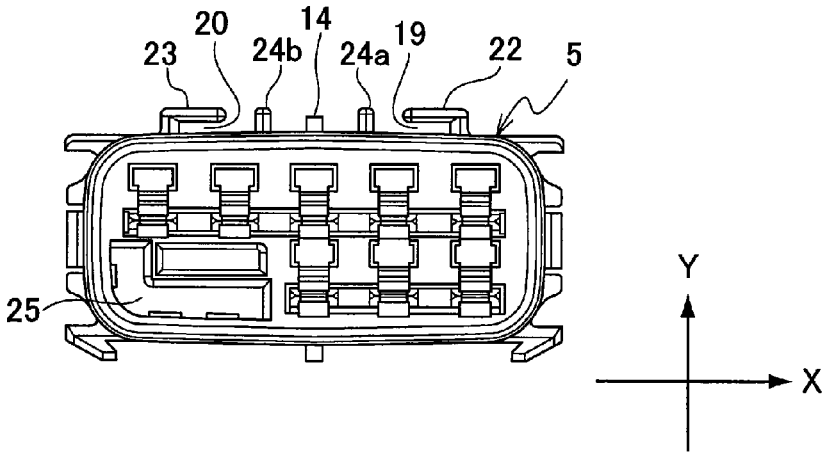
Figure 5A:
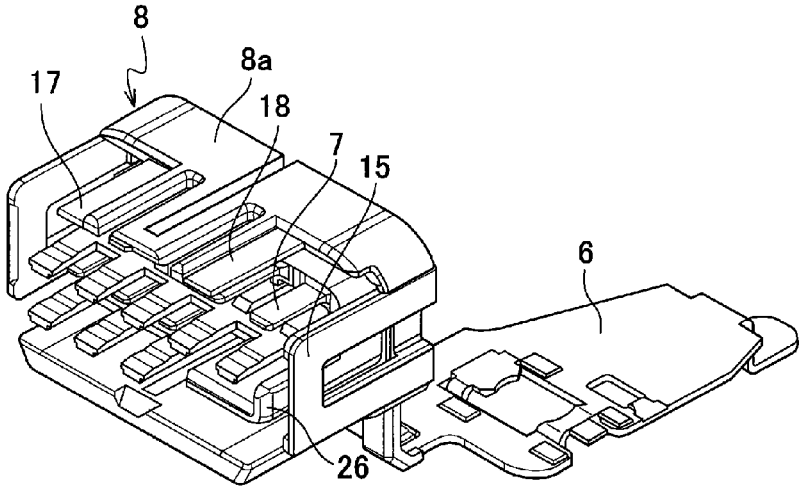
FIG. 5A is a perspective view of the male terminal housing when seen from the female terminal housing.
Figure 5B:
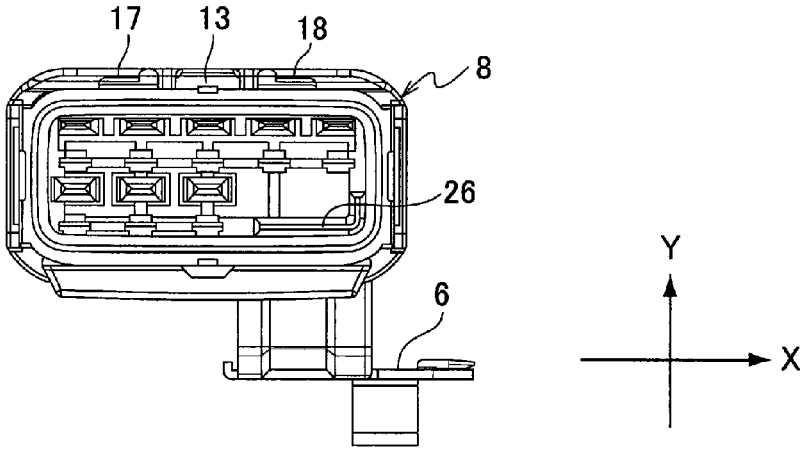
FIG. 5B is a front view of the male terminal housing when seen from the female terminal housing.
Figure 6:
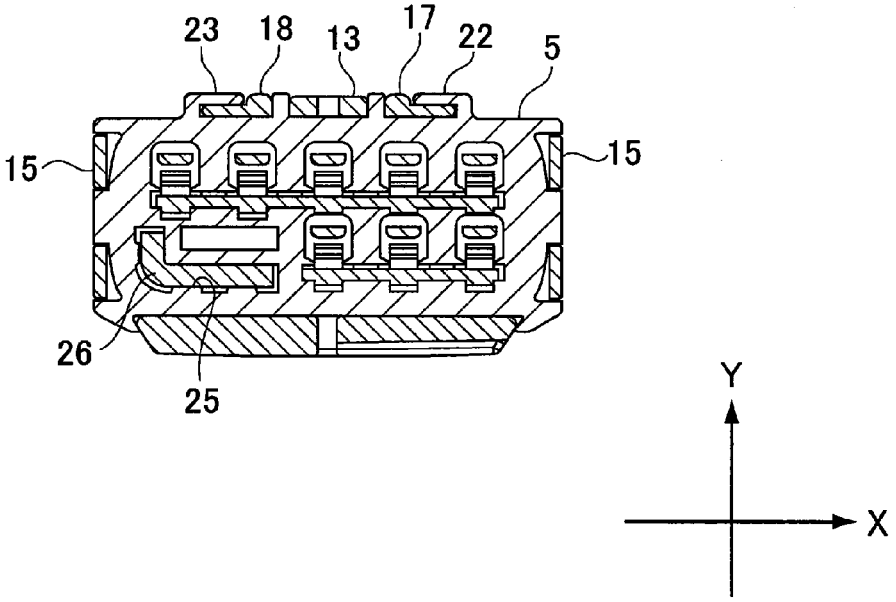
FIG. 6 is a cross-sectional view taken along the line A-A in FIG. 3B.

The waterproof ground joint connector 1 of this embodiment includes a female terminal housing 5 provided with a plurality of terminal receiving cavities 4 each of which receives a respective one of a plurality of female terminals 3 each of which is crimped onto an end of an electric wire 2, and a male terminal housing 8 to which a plurality of male terminals 7 connected to a bus bar 6 are insert-molded (see FIGS. 2A to 2C). Both the female terminal housing 5 and the male terminal housing 8 are made of resin. As illustrated in FIGS. 1A and 2B, the female terminal 3 has a contact portion 3*b* that is formed in a tubular shape and that receives a resiliently deformable contact member 3*a* therein and a crimping terminal portion 3*c* that is crimped with the electric wire 2. The terminal receiving cavity 4 of the female terminal housing 5 has a rectangle-tubular portion that is positioned at the male terminal housing 8 and that receives the contact portion 3*b* of the female terminal 3, and a cylindrical portion that receives the crimping terminal portion 3*c* and a ring packing 2*a* mounted on an outer periphery of the end of the electric wire 2

A lance 11 is made of the same resin as the housing and is formed integrally with the terminal receiving cavity 4 so as to be extended from the cylindrical portion, which receives the electric wire 2 therein, to the rectangle-tubular portion, which receives the female terminal 3 therein, in a manner of cantilever, as illustrated in FIG. 2A. Further, the lance II has a leading end protruding in the terminal receiving cavity 4. When the contact portion 3*b* of the female terminal 3 is inserted, as illustrated in FIG. 2B, the leading end is retracted from the terminal receiving cavity 4 due to the resilient deformation of the resin, and then enters into a locking hole 3*d* formed in a bottom of the contact portion 3*b*, so that the leading end of the lance 11 is engaged with the contact portion 3*b* of the female terminal 3. In this way, the female terminal 3 is prevented from being released. Further, the female terminal housing 5 includes a female hood 12 having a tubular shape which is expanded from an outer peripheral surface of the rectangle-tubular portion of the terminal receiving cavity 4.

The plurality of male terminals 7 each of which is to be inserted and connected to the plurality of corresponding female terminals 3 are insert-molded to and held in the male terminal housing 8. In each of the plurality of male terminals 7, a plate-shaped conductor is bent in a U-shape and two leading ends of it are inserted into two of the female terminals 3 in the female terminal housing 5, respectively, so that the male terminal 7 is configured to make into sliding contact with the contact member 3*a*. Although not illustrated in the drawing, the plurality of male terminals 7 are connected to a bus bar 6, and are connected and fixed to the ground conductor via the bus bar 6. Abase 8*a* of the male terminal housing 8 is provided with a body portion 9 which is capped with the female hood 12, and a ring-shaped waterproof packing 10 is mounted between the body portion 9 and the female hood 12.

Figure 1B:
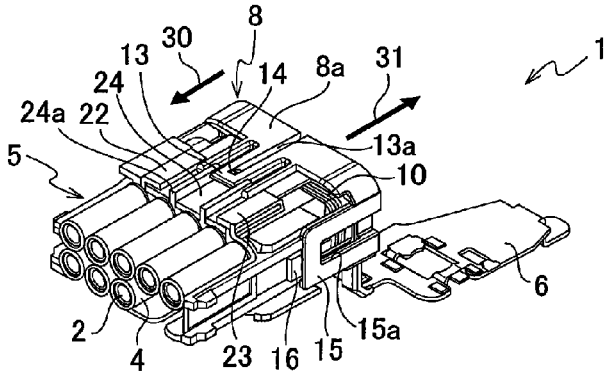
Figure 1C:
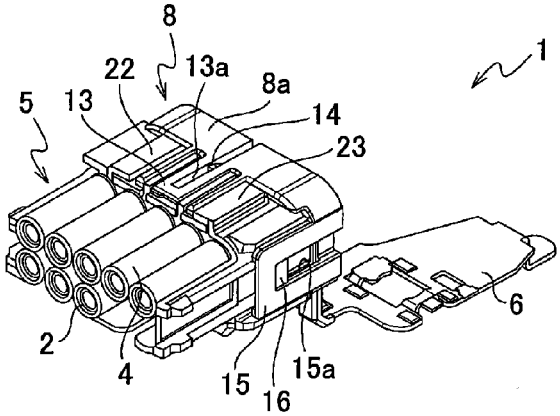

In the embodiment, the male terminal housing 8 and the female terminal housing 5 are fitted to each other and then the male terminals 7 are connected to the contact members 3*a* of the corresponding female terminals 3 through sliding contact. The female terminal housing 5 and the male terminal housing 8 have a first engagement portion and a second engagement portion, and the female terminal housing 5 and the male terminal housing 8 are fitted to each other in a first fitting position by the first engagement portion and in a second fitting position by the second engagement portion, and thus the female terminal housing 5 and the male terminal housing 8 are fitted to each other in two stages. The first fitting position is a position in which the locking hole 3*d* of the female terminal 3 is engaged with the lance 11, and the male terminal 7 is not in sliding contact with the contact member 3*a* of the female terminal 3*a*, as illustrated in FIG. 1B and FIG. 2B. Further, the second fitting position is a position in which the male terminal 7 is in sliding contact with the contact member 3*a* of the female terminal 3, as illustrated in FIG. 1C and FIG. 2C.

The first engagement portion includes: plate-shaped temporary locking arms 13 which are extended from upper and lower surfaces (upper and lower sides in the drawing) of the base 8*a* of the male terminal housing 8 toward the outer peripheral surface of the female terminal housing 5 and which are formed with locking grooves 13*a* that are elongated in a fitting direction of the female terminal housing 5 and the male terminal housing 8; and locking protrusions 14 which protrude from upper and lower surfaces of the female hood 12 of the female terminal housing 5 to correspond to the locking grooves 13*a*. A bottom of a leading end of the temporary locking arm 13 is sloped so that the temporary locking arm 13 abuts against the locking protrusion 14 and then easily rides over the locking protrusion 14 when the fitting of the female terminal housing 5 and the male terminal housing 8 is started. In addition, if the fitting of the female terminal housing 5 and the male terminal housing 8 is advanced, the locking protrusion 14 enters into the locking groove 13*a* of the temporary locking arm 13, then the first fitting position is achieved (FIG. 2A). The female terminal 3 is inserted into the terminal receiving cavity 4, and the lance 11 is locked to the locking hole 3*d* of the female terminal 3 to prevent the female terminal 3 from being released. In this state, in order to release the fitting of the female terminal housing 5 and the male terminal housing 8, it is necessary to bend the temporary locking arm 13 back to release the engagement of the locking groove 13*a* and the locking protrusion 14. In this instance, the releasing force generated only by bending the plate-shaped temporary locking arm 13 back is sufficient.

As illustrated in FIGS. 1A to 1C, 3A and 3B, the second locking portion includes: plate-shaped fully locking arm 15 which is extended from side surfaces (front and back sides in the drawing) of the base 8*a* of the male terminal housing 8 toward the outer peripheral surface of the female hood 12 of the female terminal housing 5 and which are formed with locking grooves 15*a* that are elongated in the fitting direction; and locking protrusions 16 which protrude from side surfaces (front and rear sides in the drawing) of the female hood 12 to correspond to the locking grooves 15*a*. A bottom of a leading end of the fully locking arm 15 is sloped so that the fully locking arm 15 abuts against the locking protrusion 16 and then easily rides over the locking protrusion 16 when the female terminal housing 5 and the male terminal housing 8 are fitted. As illustrated in FIG. 1B, in the first fitting position, the leading end of the fully locking arm 15 accurately abuts against the locking protrusion 16. If the female terminal housing 5 and the male terminal housing 8 are further fitted in the direction indicated by an arrow 30 shown in FIG. 1B from this position, the leading end of the fully locking arm 15 rides over the locking protrusion 16, and thus the locking protrusion 16 is locked to the inside of the locking groove 15*a*. Accordingly, even though the fitting of the female terminal housing 5 and the male terminal housing 8 is released in the direction indicated by an arrow 31 shown in FIG. 1B, a fitted state of the female terminal housing 5 and the male terminal housing 8 is maintained unless the main locking arms 15 is bent outwardly.

According to the above-described configuration, the female terminal housing 5 and the male terminal housing 8 are configured so that the both housings are separately formed and are fitted to each other in two stages. That is, the first fitting position is a position in which the locking hole 3*d* of the female terminal 3 is engaged with the lance 11, and in which the male terminal 7 is not in sliding contact with the contact member 3*a* of the female terminal 3. Since the first fitting position which corresponds to the first stage of the two stages is a temporarily fitted state, it is sufficient if there is the inserting force to allow the female terminal 3 to bend the lance 11. Further, in this instance, since the fully locking arm 15 abuts against the locking protrusion 16 and the locking groove 13*a* of the temporary locking arm 13 and the locking protrusion 14 are engaged with each other, the temporarily fitted state is maintained even though a force is applied in any of directions indicated by the arrows 30 and 31 shown in FIG. 1B.

In addition, in order to bring a fully fitted state, if the force is applied in the direction indicated by the arrow 30 in FIG. 1B, the leading end of the fully locking arm 15 rides over the locking protrusion 16. In this way, if the female terminal housing 5 and the male terminal housing 8 are fitted to each other in the second fitting position, the contact member 3*a* of the female terminal 3 is bent, and thus the male terminal 7 is slid and is inserted to a predetermined position, thereby the fitting is completed. The second fitting position which corresponds to the second stage of the two stages is the fully fitted state. The inserting force at the second stage includes only the bending force of the contact member 3*a* of the female terminal 3, and sliding friction between the male terminal 7 and the contact member 3*a*, but the inserting force to bend the lance 11 is not applied. As a result, since the maximum inserting force can be reduced, an operator performing the terminal inserting work can surely finish the terminal inserting work, and can avoid occurrence of the insertion defect of the female terminal 3. Further, the fitting of the female terminal housing 5 and the male terminal housing 8 can be easily verified by observing sound generated by the second engagement portion or an engagement state of the second engagement portion.

In this embodiment, since the female terminal housing 5 and the male terminal housing 8 are separated, it is necessary to prevent the chattering when both the housings are fitted to each other. Accordingly, in this embodiment, as shown in FIGS. 4A to 5B, the female terminal housing 5 is provided with a chattering prevention hole 25 having an L-shaped cross section which is elongated in the fitting direction, and the male terminal housing 8 is correspondingly provided with an inverted L-shaped chattering prevention member 26 protruding therefrom to fit into the chattering prevention hole 25.

According to the above-described configuration, since the sectional shapes of the chattering prevention hole 25 and the chattering prevention member 26 are formed in the L-shape, it is possible to effectively suppress the chattering in an orthogonal two-axis direction (X and Y directions in drawing) with respect to the fitting direction. Further, since the chattering prevention member 26 has a constant length in the X and Y directions and a section modulus of these directions is large, it is possible to suppress deformation in the orthogonal two-axis direction. A vibration resistance is also improved. In addition, a guide function of reliably maintaining a posture of both the housings at the fitting thereof.

Although the female terminal housing 5 is provided with the chattering prevention hole 25, and the male terminal housing is provided with the chattering prevention member 26 protruding therefrom, the present invention is not limited thereto. On the contrary, the male terminal housing 8 may be provided with the chattering prevention hole 25, and the female terminal housing 5 may be provided with the chattering prevention member 26 protruding therefrom.

In the case where the female terminal housing 5 and the male terminal housing 8 are separated, a lock mechanism for maintaining the fitting state of both the housings is required. In general, in a case of the rigid lock mechanism, the inserting force at the fitting and the releasing force at the releasing are increased depending upon a degree of rigidity. Accordingly, an object of an aspect of the embodiment is to reduce the inserting force at the fitting and the releasing force at the releasing, and to strongly reserve or maintain the fitting state.

That is, in this embodiment, as shown in FIGS. 1A to 1C, 3B and 6, a top of the leading end of the male terminal housing 8 is provided with two guide ribs 17 and 18, the guide ribs being extended toward the upper surface of the tubular female hood 12 of the female terminal housing 5 which is a mating housing to be fitted. Each of the guide ribs 17 and 18 have a cross section perpendicular to an extended direction, and the cross sections of the guide ribs 17 and 18 are formed in an L-shape in a direction opposite to each other. The upper surface of the female hood 12 is correspondingly provided with hook-shaped ribs 22 and 23 to form guide grooves 19 and 20 (shown in FIGS. 4A and 4B) into which portions of the guide ribs 17 and 18 parallel with the upper surface of the female hood 12 are inserted. Further, portions of the guide ribs 17 and 18 vertical to the upper surface of the female hood 12 are formed so as to be guided by ribs 24*a* and 24*b* which stand up from the upper surface of the female hood 12. In this instance, the ribs 24*a* and 24*b* function as a guide of the temporary locking arm 13 which is a part of the first engagement portion.

According to the above-described configuration, both the housings are fitted to each other by inserting the two guide ribs 17 and 18 formed on the leading end of the male terminal housing 8 into the guide grooves 19 and 20 provided on the upper surface of the female hood 12 of the female terminal housing 5. Therefore, the posture is corrected when the housings are fitted to each other, so that the fitting can be smoothly performed. For this reason, the elements which are locked to each other and released from each other by a small resiliently deforming force can be employed in the first engagement portion and the second engagement portion. As a result, it is possible to reduce the inserting force when the female terminal housing and the male terminal housing 8 are fitted to each other, and the releasing force when they are released.

In this instance, instead of the guide grooves 19 and 20 of this embodiment, a guide tube formed to enclose the outer periphery of the guide ribs 17 and 18 may be used. Further, instead of that the cross sections of the guide ribs 17 and 18 are formed in the hook shape, the thickness of the ribs may be thickened to form a board type.

According to an aspect of the invention, the female terminal housing and the male terminal housing are configured so that the both housings are separated and are fitted in two stages when the female terminal is connected to the male terminal. That is, the first fitting position is the position in which the locking hole of the female terminal is engaged with the lance, and in which the male terminal is not in sliding contact with the contact member of the female terminal. This is a temporarily fitting state in which the male terminal is not connected to the female terminal. Since it is sufficient till the temporarily fitting state if there is an inserting force corresponding to a resilient deforming force to allow the female terminal to bend the lance, it is possible to reduce the inserting force, in comparison with the related art. Arriving at the first fitting position can be easily felt by an operator due to sound generated by the first engagement portion. Subsequently, if both the housings are fitted to the second fitting position, the contact member of the female terminal is bent, and the male terminal is slid and then is inserted to a predetermined position. In this instance, the inserting force can be reduced only by a bending force of the contact member of the female terminal, and sliding friction between the contact members. As a result, the maximum inserting force can be reduced, the operator performing the female terminal inserting work can surely finish the terminal inserting work, and can avoid occurrence of the insertion defect of the female terminal. Further, the fitting of the female terminal housing and the male terminal housing can be easily verified by observing the sound generated by the second engagement portion or the engagement state of the second engagement portion.

According to an aspect of the invention, since the sectional shapes of the chattering prevention hole and the chattering prevention member are formed in the L-shape, it is possible to effectively suppress the chattering in the orthogonal two-axis direction with respect to the fitting direction. Further, it is possible to suppress deformation in the orthogonal two-axis direction.

According to an aspect of the invention, since the guide groove or the guide tube, into which at least two guide ribs provided on one of the housings are fitted, is provided on the other of the housings, its posture is corrected when the housings are fitted to each other, so that the fitting can be smoothly performed. For this reason, elements which are engaged to each other and released from each other by the small resiliently deforming force can be employed in the first engagement portion and the second engagement portion. As a result, it is possible to reduce the inserting force when the female terminal housing and the male terminal housing are fitted to each other, and the releasing force when they are released. Further, since the guide ribs are fitted into the guide groove or the guide tube, it is possible to further prevent the chattering when both the housings are fitted to each other.

According to an aspect of the invention, the female terminal housing and the male terminal housing are separated, and the maximum inserting force when a female terminal is connected with a male terminal can be reduced.

According to an aspect of the invention, the chattering can be effectively reduced in a state in which the female terminal housing and the male terminal housing are fitted to each other. According to an aspect of the invention, it is possible to reduce the inserting force when the female terminal housing and the male terminal housing are fitted to each other, and the releasing force when they are released.

What is claimed is:

1. A connector comprising:

a female terminal housing provided with a terminal receiving cavity configured to receive a female terminal; and a male terminal housing configured to retain a male terminal to be connected to the female terminal, wherein a lance made of a resilient member and formed on an inner wall of the terminal receiving cavity is engaged with a locking hole formed in a tubular portion having a resiliently deformable contact member therein of the female terminal, and the male terminal housing and the female terminal housing are fitted to each other to allow the male terminal to be in sliding contact with the contact member of the female terminal, wherein:

the male terminal is insert-molded to the male terminal housing;

the male terminal housing and the female terminal housing have a first engagement portion and a second engagement portion;

the male terminal housing and the female terminal housing are fitted to each other in a first fitting position by the first engagement portion;

the male terminal housing and the female terminal housing are fitted to each other in a second fitting position by the second engagement portion;

the first fitting position is a position in which the locking hole of the female terminal is engaged with the lance, and in which the male terminal is not in sliding contact with the contact member of the female terminal;

the second fitting position is a position in which the male terminal is in sliding contact with the contact member of the female terminal;

the first engagement portion includes: a first arm provided on a first surface of the male terminal housing and formed with a first groove; and a first protrusion protruding from a first surface of the female terminal housing and corresponding to the first groove of the first arm;

the second engagement portion includes: a second arm provided on a surface of the male terminal housing and formed with a second groove; and a second protrusion protruding from a second surface of the female terminal housing and corresponding to the second groove of the second arm;

in the first position, the first protrusion is engaged with the first groove of the first arm, and a leading end of the second arm abuts against the second protrusion; and in the second fitting position, the second protrusion is engaged with the second groove of the second arm.

2. The connector according to claim 1, wherein one of the male terminal housing and the female terminal housing is provided with a hole which is elongated in a fitting direction and which has a cross section of an L-shape, and the other of the male terminal housing and the female terminal housing is provided with a member which protrudes therefrom to fit into the hole and which has a cross section of an L-shape.

3. The connector according to claim 1, wherein one of a leading end of male terminal housing and a leading end of the female terminal housing is provided with at least two guide ribs which are extended toward the other of the male terminal housing and the female terminal housing, and the other of the male terminal housing and the female terminal housing is provided with at least one of guide grooves and guide tubes to which the two guide ribs are fitted.

* * * * *